US007392781B2

(12) United States Patent
Takahashi et al.

(10) Patent No.: US 7,392,781 B2
(45) Date of Patent: Jul. 1, 2008

(54) CRANKSHAFT OF PISTON CRANK MECHANISM

(75) Inventors: Naoki Takahashi, Yokohama (JP); Katsuya Moteki, Tokyo (JP); Hideaki Mizuno, Yokohama (JP); Yoshimi Nunome, Yokosuka (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 11/713,128

(22) Filed: Mar. 2, 2007

(65) Prior Publication Data

US 2007/0204829 A1 Sep. 6, 2007

(30) Foreign Application Priority Data

Mar. 3, 2006 (JP) ..... 2006-057068

(51) Int. Cl.
*F02B 75/32* (2006.01)

(52) U.S. Cl. ..... 123/197.4; 123/78 E

(58) Field of Classification Search ..... 123/192.1, 123/192.2, 48 B, 78 E, 78 F, 197.4
See application file for complete search history.

(56) References Cited

U.S. PATENT DOCUMENTS

| | | | | |
|---|---|---|---|---|
| 6,505,582 | B2 * | 1/2003 | Moteki et al. | 123/48 B |
| 6,546,900 | B2 * | 4/2003 | Arai et al. | 123/48 B |
| 6,561,142 | B2 * | 5/2003 | Moteki et al. | 123/48 B |
| 6,615,773 | B2 * | 9/2003 | Moteki et al. | 123/48 B |
| 6,622,670 | B2 * | 9/2003 | Hiyoshi et al. | 123/48 B |
| 6,684,828 | B2 * | 2/2004 | Ushijima et al. | 123/48 B |
| 6,877,463 | B2 * | 4/2005 | Moteki et al. | 123/48 B |
| 7,117,838 | B2 * | 10/2006 | Aoyama et al. | 123/197.1 |
| 7,121,251 | B2 * | 10/2006 | Moteki et al. | 123/197.1 |
| 2006/0102116 | A1 * | 5/2006 | Maezuru et al. | 123/78 E |
| 2007/0056552 | A1 * | 3/2007 | Fisher | 123/197.4 |
| 2007/0137606 | A1 * | 6/2007 | Takahashi et al. | 123/195 R |

FOREIGN PATENT DOCUMENTS

| | | |
|---|---|---|
| JP | 63-088217 | 4/1988 |
| JP | 1116311 | 5/1989 |
| JP | 2001-227367 | 8/2001 |
| JP | 2002-61501 | 2/2002 |

OTHER PUBLICATIONS

English Abstract for JP-1116311.
English Abstract provided for JP-2001-227367.
English Abstract provided for JP-2002-61501.
English Abstract provided for JP-63-088217.

* cited by examiner

*Primary Examiner*—Hai H Huynh
(74) *Attorney, Agent, or Firm*—Global IP Counselors, LLP

(57) ABSTRACT

A crankshaft mechanism is disclosed that takes advantage of component makeup and orientation to cancel out inertial force. A crankshaft of the crankshaft mechanism includes at least one counterweight that is arranged in combination with the rest of the mechanism to cancel out the inertial force particularly at a timing in front of a bottom dead center of a piston where the inertial force becomes a maximum.

8 Claims, 8 Drawing Sheets

CRANKSHAFT OF PISTON CRANK MECHANISM

CROSS-REFERENCES TO RELATED APPLICATION

This application claims priority from Japanese Patent Application Serial No. 2006-057068 filed Mar. 3, 2006, which is hereby incorporated by reference.

TECHNICAL FIELD

A piston crank mechanism used in, for example, an internal combustion engine, is discussed. More particularly, this disclosure relates to a crankshaft in a multiple-link-type piston crank mechanism

BACKGROUND

Examples of variable compression ratio internal combustion engines using a multiple-link-type piston crank mechanism are discussed in Japanese Unexamined Patent Application Publication Nos. 2001-227367 and 2002-61501, the contents of which are hereby incorporated by reference. Such variable compression ratio internal combustion engines allow the selection of an optimum compression ratio according to an operation condition. Compared to other internal combustion engines, such variable compression ratio engines may produce less engine emissions, while also increasing the efficiency and output of the engine, and also reducing rotational secondary inertial forces.

SUMMARY

Accordingly, a crankshaft that is made suitable by a multiple-link-type piston crank mechanism is described.

To this end, the disclosure describes a structure comprising an upper link having one end connected to a piston through a piston pin, a lower link that connects the other end of the upper link and a crank pin of a crankshaft to each other, and a control link having one end rotatably supported by an eccentric cam provided at a control shaft supported by a cylinder block and having the other end connected to the lower link. The upper link and the lower link are rotatably connected to each other through an upper pin. The control link and the lower link are rotatably connected to each other through a control pin. The crank pin is disposed between the upper pin and the control pin. As viewed from a direction in which the crankshaft rotates counterclockwise, the upper pin is disposed on the right of the control pin, and a center of gravity of a counterweight of the crankshaft exists at a forward side in the direction of rotation of the crankshaft.

According to the crankshaft of the present disclosure, it is possible to effectively cancel out inertial force of the multiple-link-type piston crank mechanism by a counterweight in accordance with its direction, in particular, at a timing in front of a bottom dead center where the inertial force becomes a maximum.

BRIEF DESCRIPTION OF THE DRAWINGS

While the claims are not limited to the illustrated embodiments, an appreciation of various aspects is best gained through a discussion of various examples thereof. Referring now to the drawings, illustrative embodiments are shown in detail. Although the drawings represent the embodiments, the drawings are not necessarily to scale and certain features may be exaggerated to better illustrate and explain an innovative aspect of an embodiment. Further, the embodiments described herein are not intended to be exhaustive or otherwise limiting or restricting to the precise form and configuration shown in the drawings and disclosed in the following detailed description. Exemplary embodiments of the present invention are described in detail by referring to the drawings as follows.

DETAILED DESCRIPTION

Figure 1:
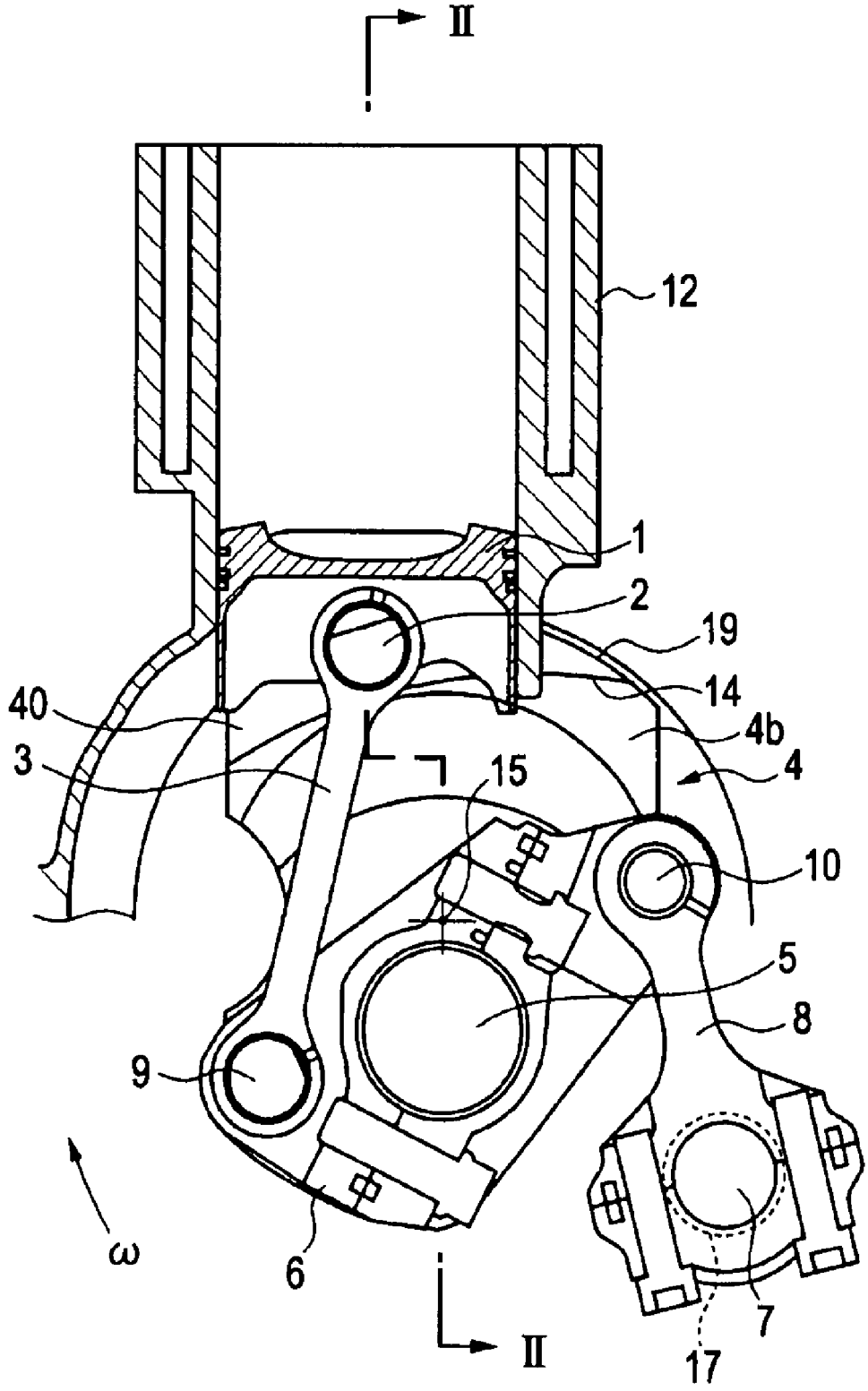
FIG. 1 is a sectional view of the main portion of an internal combustion engine including a crankshaft according to a first exemplary embodiment.

FIGS. 1-4 illustrate a first exemplary embodiment. FIG. 1 shows structural parts of one cylinder of a multiple-link type in-line four-cylinder internal combustion engine. More specifically, FIG. 1 is a sectional view of the internal combustion engine as seen from a direction in which a rotational direction ω of a crankshaft 4 is defined as a clockwise direction (right rotation).

A multiple-link-type piston crank mechanism includes an upper link 3 connected to a piston 1 through a piston pin 2; a lower link 6 that connects the upper link 3 and a crank pin 5 of the crankshaft 4 to each other; a control shaft 17 that extends substantially parallel to the crankshaft 4 and that is supported by a cylinder block 12; and a control link 8 having one end rotatably supported by an eccentric cam 7, provided at the control shaft 17, and the other end connected to the lower link 6. (Refer to FIG. 9 which is a vertical sectional view of a related variable compression ratio internal combustion engine of a multiple-link type.) A rotational center of the control link 8 at the eccentric cam 7 and a rotational center of the control shaft 17 are decentered. An orientation of the lower link 6 changes in accordance with the rotational position of the control shaft 17, so that the distance from the crank pin 5 to the piston pin 2 changes. The upper link 3 and the lower link 6 are rotatably connected to each other through an upper pin 9. The control link 8 and the lower link 6 are rotatably connected to each other through a control pin 10. The crank pin 5 is disposed between the upper pin 9 and the control pin 10.

Figure 2:
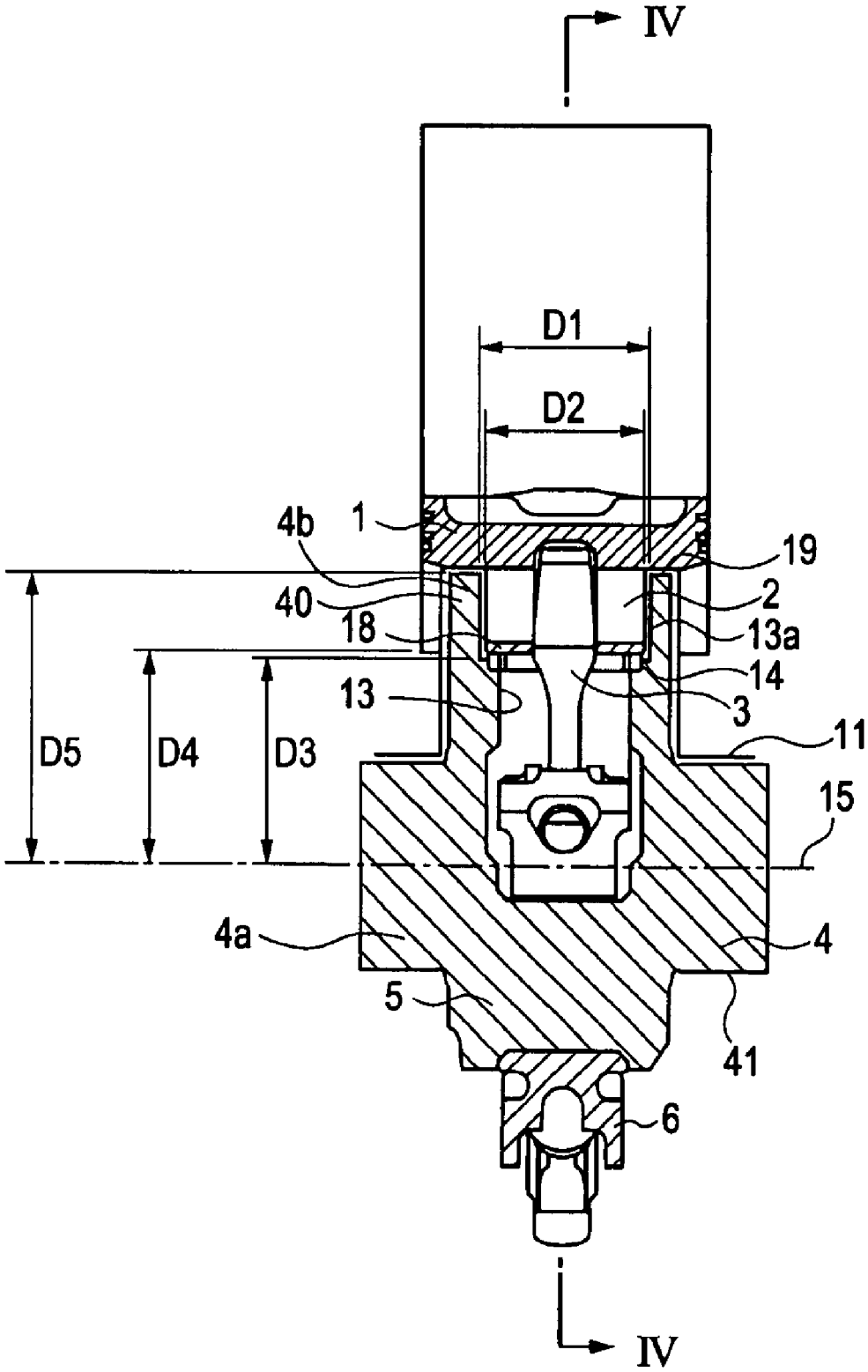
FIG. 2 is a sectional view taken along line II-II shown in FIG. 1.

The crankshaft 4, as shown in FIG. 2, includes a main journal 41, the crank pin 5, a crank web 4*a*, and a counterweight 4*b*. The main journal 41 is rotatably supported by a main bearing 11 provided at a bulk head of the cylinder block 12. The crank pin 5 is disposed at a portion that is decentered from a rotational center of the main journal 41 and is connected to the lower link 6. The crank web 4*a* connects the main journal 41 and the crank pin 5 to each other. The counterweight 4*b* and the crank pin 5 are formed on respective sides of a main journal center 15 so as to be opposite to each other. The counterweight 4*b* is integrated to the crank web 4*a* so as to cancel out a rotational unbalance occurring due to the crank pin 5, having a main journal rotational axis as a center, and the lower link 6, and the upper link 3, which are connected to the crank pin 5.

Figure 3:
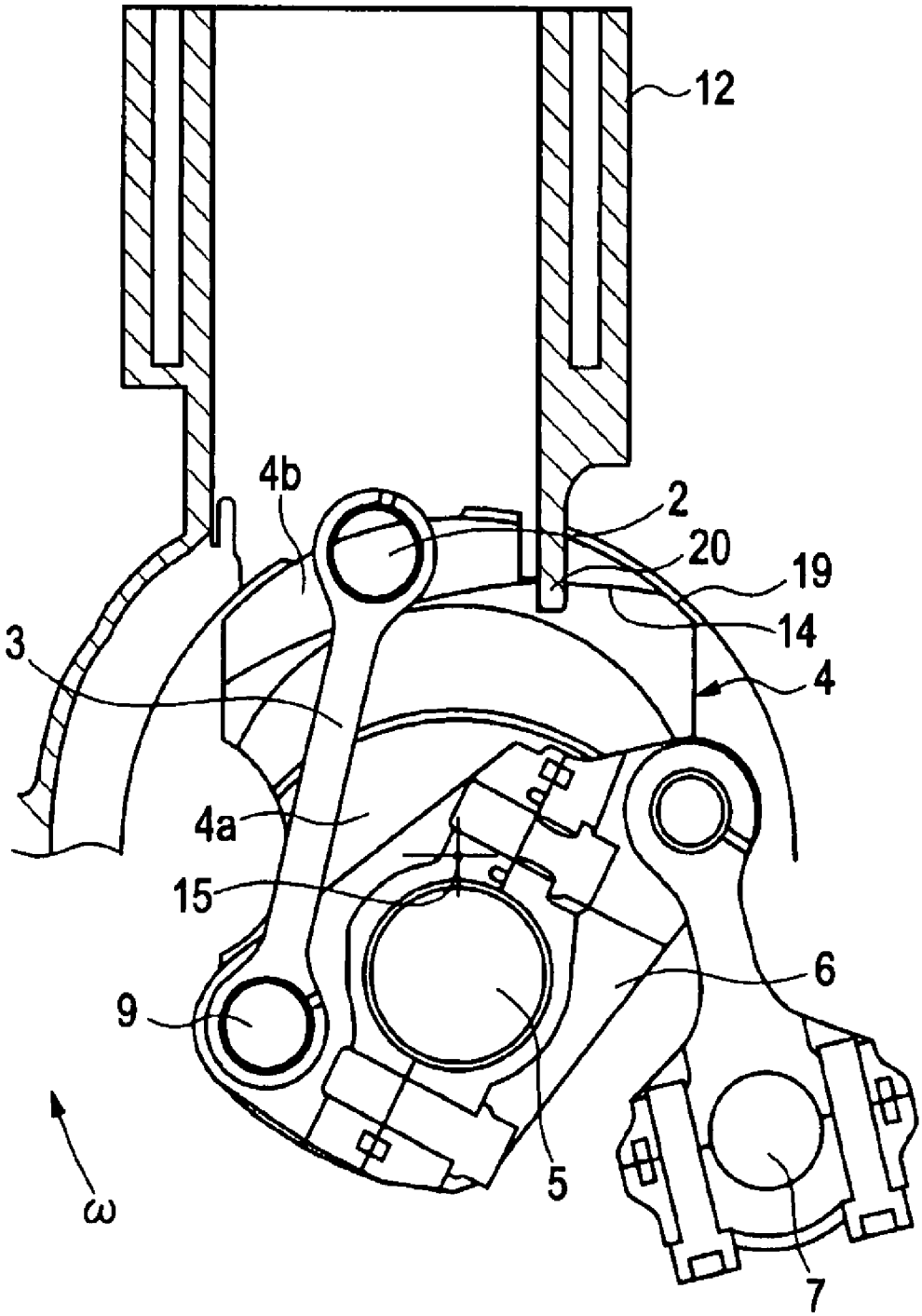
FIG. 3 shows the internal combustion engine shown in FIG. 1 without a piston.
Figure 4:
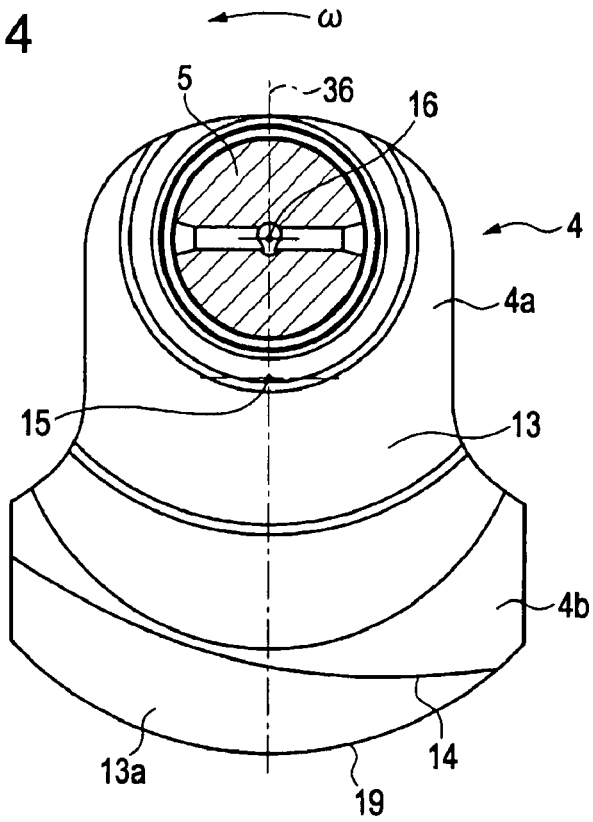
FIG. 4 is a sectional view of the crankshaft taken along line IV-IV shown in FIG. 2.

FIG. 2 is a sectional view taken along line II-II shown in FIG. 1. FIG. 3 shows the internal combustion engine shown in FIG. 1 without the piston 1. FIG. 4 is a sectional view of the crankshaft 4 taken along line IV-IV shown in FIG. 2, so that it only shows the crank web 4*a* and the counterweight 4*b*. In FIGS. 4-7, and 10, the rotational direction ω of the crankshaft 4 is defined as a counterclockwise direction (left rotation).

Figure 9:
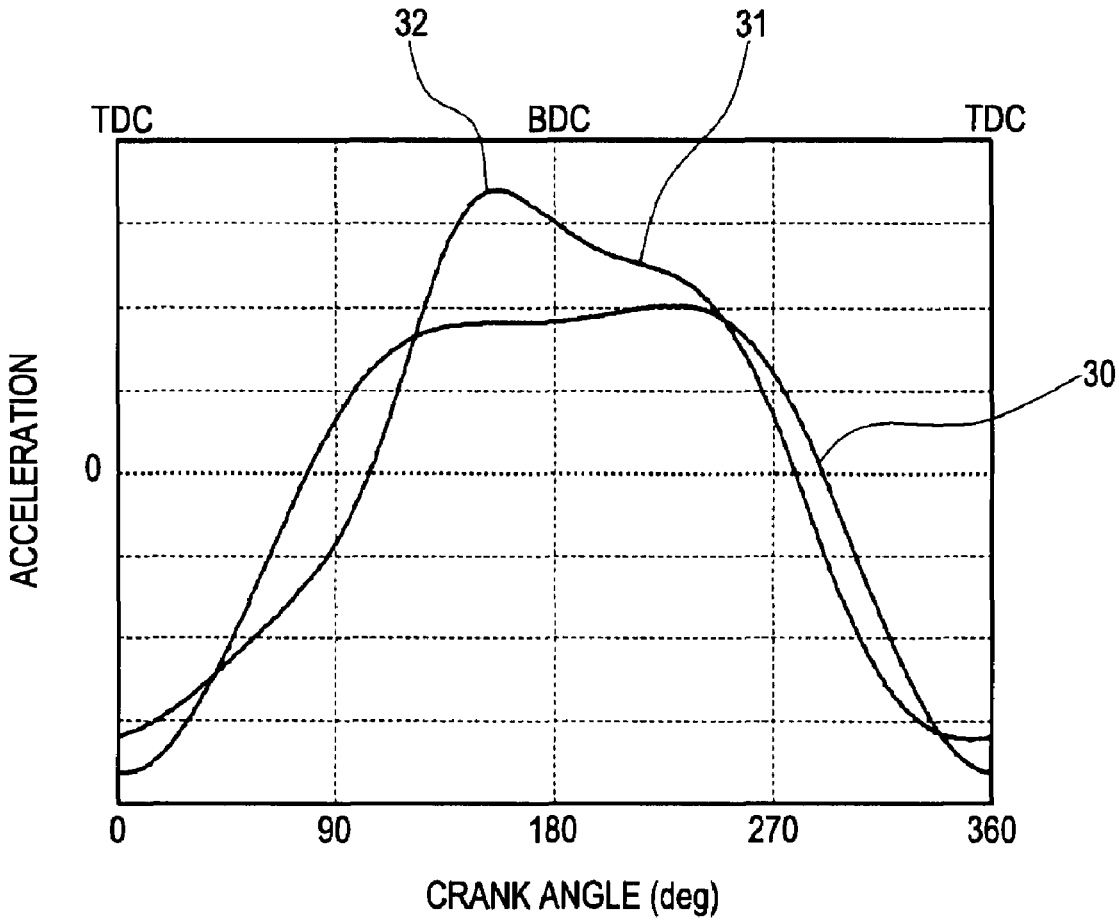
FIG. 9 is a characteristic diagram showing the difference between piston acceleration of a simple-link type and that of a multiple-link type.

The internal combustion engine including the multiple-link-type piston crank mechanism is similar to a general simple-link-type piston crank mechanism in that it operates on the same principle that rotational motion of the crankshaft is converted into reciprocating motion of the piston. However, since it uses a different link mechanism to achieve this, it has different dynamic characteristics. FIG. 9 shows acceleration of a general simple-link-type internal combustion engine and that of the above-described multiple-link-type internal combustion engine in terms of crank angle at a horizontal-axis. A characteristic that is represented by reference numeral 30 corresponds to the acceleration of the simple-link-type piston crank mechanism and a characteristic that is represented by reference numeral 31 corresponds to the acceleration of the multiple-link-type piston crank mechanism.

As illustrated, in the simple-link-type internal combustion engine, the amplitude of the acceleration of the piston reciprocating motion becomes a maximum at a timing near a top dead center. The amplitude of the downward acceleration that causes a shift from an upward motion of the piston to a downward motion of the piston is larger than the amplitude of the upward acceleration that causes a shift from the downward motion to the upward motion of the piston. In contrast, in the multiple-link-type internal combustion engine, the amplitude of the upward acceleration that causes a shift from the downward motion to the upward motion of the piston is larger than the amplitude of the downward acceleration that causes a shift from the upward motion to the downward motion of the piston. In addition, the acceleration becomes a maximum at a timing (represented by reference numeral 32) that is slightly in front of a bottom dead center.

Figure 10:
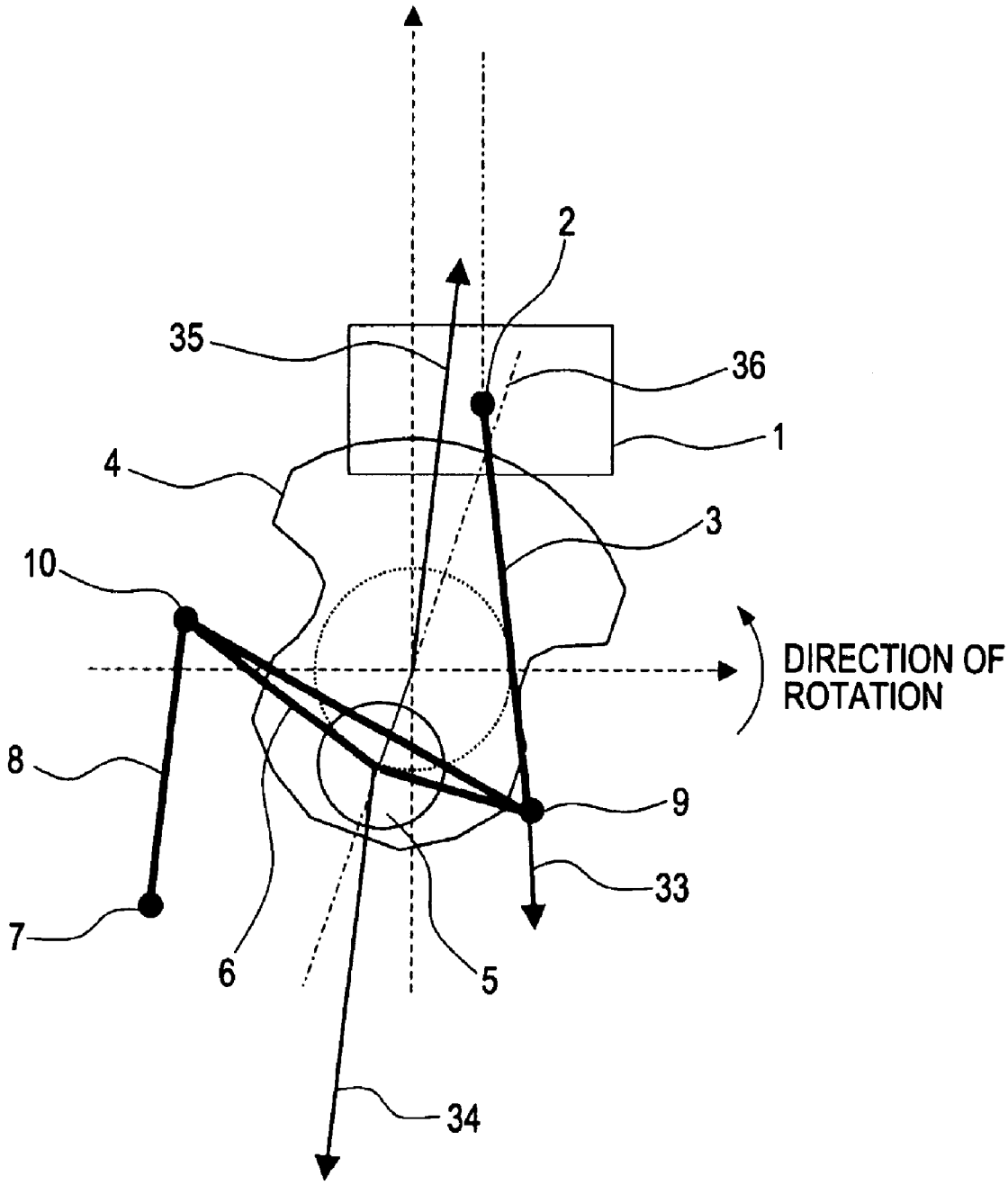
FIG. 10 illustrates the forces of respective parts at a moment when inertial force in the multiple-link-type piston crank mechanism becomes a maximum.

FIG. 10 illustrates inertial force on each part of the multiple-link-type internal combustion engine at the timing that is in front of the bottom dead center where the piston acceleration becomes a maximum, that is, the inertial force of the moving parts becomes a maximum. To simplify the figure, the upper link 3, the lower link 6, and the control link 8 are illustrated by straight lines, respectively, and the connecting parts that rotatably connect a plurality of parts, that is, the piston pin 2, the upper pin 9, the control pin 10, and the eccentric cam 7 are illustrated by points, respectively. As illustrated in FIG. 10, from the direction in which the direction of rotation of the crankshaft is counterclockwise, the upper pin 9 is disposed on the right of the control pin 10.

Here, since the motion of the piston 1 is shifted from the downward motion to the upward motion, an upward force is input from the piston pin 2. The force that pushes the piston 1 upward passes through the upper link 3, so that force that tries to move the upper link 3 itself upward is added in the sum total force, and the total force passes through the upper pin 9 so as to be transmitted as a downward load 33 to the lower link 6. The lower link 6 acts as a type of lever with the control pin 10 acting as a fulcrum, the upper pin 9 acting as a power point, and the crank pin 5 acting as an action point. The amplitude of the downward load 33 from the upper link 3 is increased, and the inertial force of the lower link 6 itself is added to add an illustrated downward-and-leftward load 34 to the crank pin 5. To cancel out the inertial force 34 transmitted to the crank pin 5 and minimize radial load that is transmitted to the main journal from the cylinder block, the counterweight must generate a force acting in the direction of arrow 35. This force is displaced by a certain angle from a central line viewed from the front of the crankshaft 4, that is, a straight line 36 connecting the center of the main journal and the center of the crank pin 5. Therefore, to efficiently cancel out the inertial force that is produced at a moment when the inertial force of the multiple-link-type internal combustion engine becomes a maximum, it is desirable that the center of gravity of the counterweight of the crankshaft 4 exist to the right of the straight line connecting the center of the main journal and the center of the crank pin 5, when the crankshaft 4 is illustrated as rotating counterclockwise, and the center of the main journal is defined as the origin and the center of the crank pin is set at an upper side thereof. That is, the center of gravity of the counterweight of the crankshaft 4 is made to exist towards the forward side in the direction of rotation of the crankshaft.

As most clearly shown in FIG. 4, in this embodiment, steps 14 that are boundaries for changes in wall thickness are provided at side surfaces 13 of the counterweight 4*b* at the side of the crank pin 5, that is, at the inner side surfaces 13 that oppose each other. From the steps 14 serving as the boundaries, the wall thickness of portions of the counterweight 4*b* that are close to the main journal center 15 is greater than the wall thickness of portions of the counterweight 4*b* that are far away from the main journal center 15. The steps 14 are situated far away from the main journal center 15 at the right side of the figure, and are situated close to the main journal center 15 at the left side of the figure. Accordingly, thin-wall portions 40 are formed at the rearward side of the counterweight 4*b* in the direction of rotation of the crankshaft. The wall thickness of the thin-wall portions 40 (illustrated in FIGS. 1 and 2) is less than the wall thickness of the forward side of the counterweight 4*b* in the direction of rotation of the crankshaft. Accordingly, the volume of the counterweight of the crankshaft 4 at its forward side in the direction of rotation of the crankshaft is larger than the volume of the counterweight at its rearward side in the direction of rotation of the crankshaft. Since the counterweight 4*b* has such a shape, the center of gravity of the crank web 4*a* and the center of gravity of the counterweight 4*b* exist to the right of the straight line 36 connecting the main journal center 15 and a crank pin center 16 in FIG. 4. In other words, the center of gravity of the counterweight of the crankshaft exists at the forward side in the direction of rotation of the crankshaft. Therefore, when the internal combustion engine is operating, the direction of the inertial force that is generated by the counterweight 4*b* is rightward in FIG. 4, so that this inertial force acts in the direction in which the inertial force of the above-described multiple-link-type piston crank mechanism cancels out. In addition, when an end of the counterweight 4*b* that does not contribute so much to the rigidity of the crankshaft 4 is reduced in weight while an area of the counterweight 4*b* that is close to the main journal and that contributes to the rigidity of the crankshaft 4 has its wall thickness kept the same, the internal combustion engine can be reduced in size and weight. An outer periphery 19 of the counterweight 4*b* forms an arc shape in which the main journal center 15 is the center.

FIGS. 1 and 2 show the disposition of each part at the timing that is close to the bottom dead center of the piston 1. A distance (D1) between the opposing side surfaces 13*a* for the thin-wall portions 40 of the counterweight 4*b* is greater than a distance (D2) between axial ends of a piston pin boss 18 for rotatably supporting the piston pin 2 of the piston 1. At the same time, a distance (D3) from the main journal center 15 to the steps 14 that are closest to the piston pin boss 18 is less than a distance (D4) from the main journal center 15 to a lower end of the piston pin boss 18. Further, a distance (D5) from the main journal center 15 to the outer periphery 19 of the counterweight 4*b* is greater than the distance (D4) from the main journal center 15 to the lower end of the piston pin boss 18. Accordingly, when the piston 1 is at its bottom dead center, the thin-wall portions 40 of the counterweight 4*b* extend so as to overlap axial sides of the piston pin boss 18.

The related multiple-link-type internal combustion engine may be capable of having a structure in which the compression ratio can be varied. Furthermore, its piston reciprocation stroke can be made larger than a crank throw (distance from the main journal rotational center to the center of the crank pin 5) as a result of the lower link 6 of the multiple-link-type piston crank mechanism acting as a lever. In other words, in the related internal combustion engine using a simple-link-type piston crank mechanism, a crank throw must be made large to increase a stroke of a piston reciprocation motion, as a result of which space occupied by the crankshaft when it is rotating must be made larger. On the other hand, in a properly designed multiple-link-type mechanism, the piston stroke can be increased without increasing the space occupied by the crankshaft. In particular, it is possible to realize an internal combustion engine having a large displacement while a portion of the internal combustion engine below the rotational center of the crankshaft 4 is kept small, so that the center of gravity of the internal combustion engine and, thus, the center of gravity of a vehicle to which the engine is mounted is lowered.

However, when an attempt is made to increase the piston stroke by using the multiple-link-type piston crank mechanism, the total height of the internal combustion engine is increased by an amount corresponding to the increased piston stroke. If an attempt is made to increase the piston stroke while maintaining the total height of the internal combustion engine at a certain value, the position of the piston at the bottom dead center approaches the rotational center of the crankshaft. As a result, the outer peripheral portion of the crankshaft and the piston may interfere with each other. Japanese Unexamined Patent Application Publication No. 63-88217, and is incorporated herein in its entirety, focuses on the problem that the piston and the crankshaft interfere with each other.

However, in the present exemplary embodiment, the above-described structure makes it possible to prevent the counterweight and the piston pin boss from interfering with each other at the timing that is close to the bottom dead center of the piston stroke of the internal combustion engine. The distance from the lower end of the piston 1 to the main journal center 15 at the bottom dead center can be smaller than that in the internal combustion engine using a simple-link-type piston crank mechanism or in the related multiple-link-type combustion engine. In other words, using the crankshaft 4 according to the present disclosure, while maintaining the height of the cylinder block of the internal combustion engine at a certain value, makes it possible to increase the stroke of the piston 1 and, thus, increase the displacement. In the internal combustion engine using an ordinary simple-link-type piston crank mechanism, the stroke of the piston is substantially twice the crank throw (that is, the distance from the main journal center 15 to the crank pin center 16), whereas, in the internal combustion engine using a multiple-link-type piston crank mechanism, the piston stroke is at least twice the crank throw due to the lower link 6 serving as a lever. In particular, if the link geometry (length of each link) of the multiple-link-type piston crank mechanism is properly set, a large piston-stroke increase results.

While preventing the counterweight 4*b* and the piston pin boss 18 from interfering with each other, it is possible to increase a maximum outside diameter of the counterweight 4*b*, so that the effect of canceling out inertial force of the moving parts can be made more noticeable by the use of the counterweight.

Figure 5:
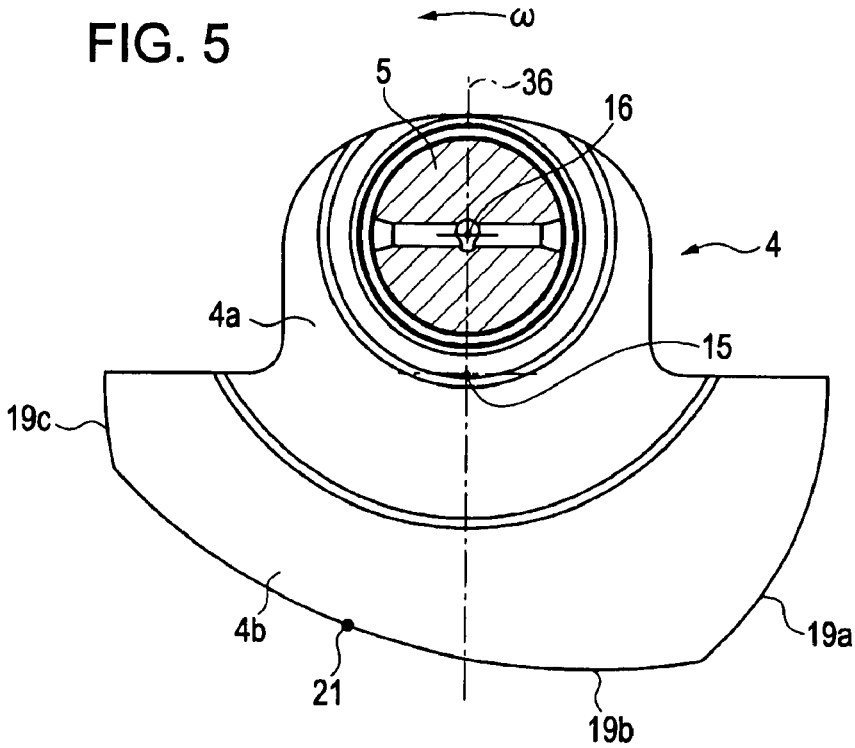
FIG. 5 is a sectional view that is similar to FIG. 4 illustrating a second exemplary embodiment.

FIG. 5 shows a second exemplary embodiment, and is a sectional view of a crankshaft 4 taken along the same line as that in FIG. 4.

An external outline (contour) 19 of a counterweight 4*b* of the crankshaft 4 according to the second embodiment is defined by portions 19*a* and 19*c*, which are arcs that are concentric with a main journal center 15, and a portion 19*b*, which is not an arc that is concentric with the main journal center 15. Distances from the main journal center 15 to arbitrary points on the outline portion 19*b*, which is not concentric with the main journal center 15, are as follows. When a straight line 36 connecting the main journal center 15 and a crank pin center 16 is defined as a center, the distance at the right side in the figure is large and that at the left side of the figure is small. In other words, in the portion 19*b*, which is not an arc that is concentric with the main journal center 15, the distance from the main journal center 15 to the outer periphery of the counterweight is greater at the forward side in the direction of rotation of the crankshaft than at the rearward side in the direction of rotation of the crankshaft. Therefore, the center of gravity of the crankshaft 4 according to the second embodiment and the center of gravity of the counterweight 4*b* thereof are also disposed on the right of the straight line 36 in the figure, so that it is possible to effectively cancel out the inertial force of a multiple-link-type piston crank mechanism.

In the second embodiment, a maximum outside diameter of the counterweight 4*b* having the main journal center 15 as the center corresponds to the outside diameters of the portions 19*a* and 19*c*, which are arcs that are concentric with the main journal center 15, and a minimum outside diameter of the counterweight 4*b* corresponds to an outside diameter at a point that is represented by reference numeral 21 on the outline portion 19*b*. The point 21 is a peripheral position that is closest to a piston pin boss 18 of a piston 1 at a timing at which the piston 1 is positioned at a bottom dead center. In the embodiment, the minimum outside diameter of the counterweight 4*b* is smaller than a distance from the main journal center 15 to a lower end of the piston pin boss 18 at the bottom dead center, whereas the maximum outside diameter of the counterweight 4*b* is larger than the distance from the main journal center 15 to the piston pin boss 18 at the bottom dead center. Therefore, as in the first embodiment, while making the outside diameter of the counterweight 4*b* large and ensuring a good inertial-force canceling effect, it is possible to prevent interference between the counterweight 4*b* and the piston pin boss 18, so that an internal combustion engine having a piston stroke that is linger than that that of a related internal combustion engine can be realized.

Figure 6:
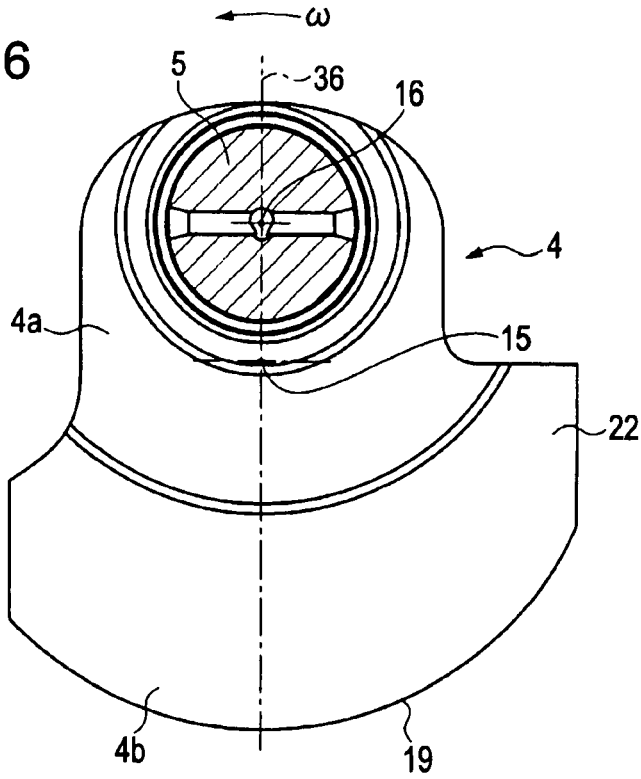
FIG. 6 is a sectional view that is similar to FIG. 4 illustrating a third exemplary embodiment.

FIG. 6 is a sectional view that is similar to FIG. 4 and that shows a crankshaft 4 according to a third illustrative embodiment. In FIG. 6, the shapes of the outlines of a crank web 4*a* and a counterweight 4*b* of the crankshaft 4 are not symmetrical in the left-right direction with respect to a straight line 36 connecting a main journal center 15 and a crank pin center 16, and a protrusion 22 extending in a peripheral direction is provided at an illustrated right portion of the crankshaft 4. Accordingly, the center of gravity of the counterweight 4*b* is disposed towards the right side in the figure with respect to the straight line 36, that is, the center of gravity of the counterweight of the crankshaft 4 exists at the forward side in the direction of rotation of the crankshaft, so that it is possible to efficiently cancel out the inertial force of a multiple-link-type piston crank mechanism.

Figure 7:
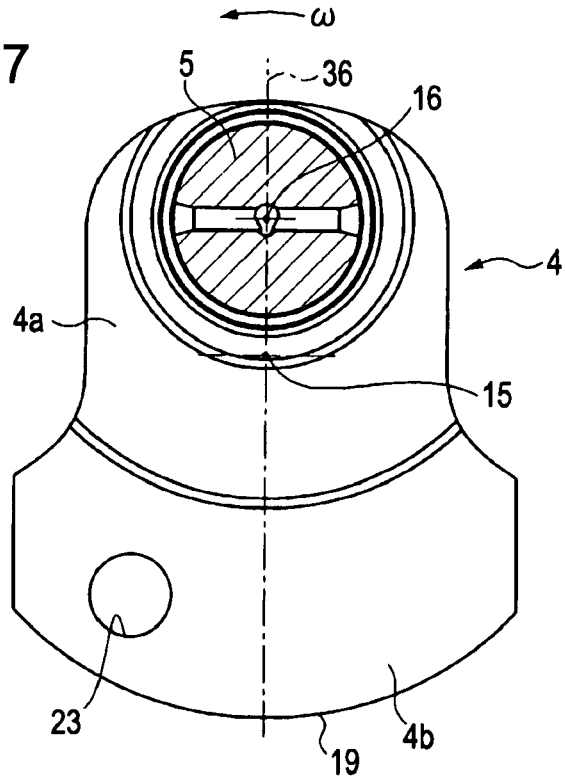
FIG. 7 is a sectional view that is similar to FIG. 4 illustrating a fourth exemplary embodiment.
Figure 8:
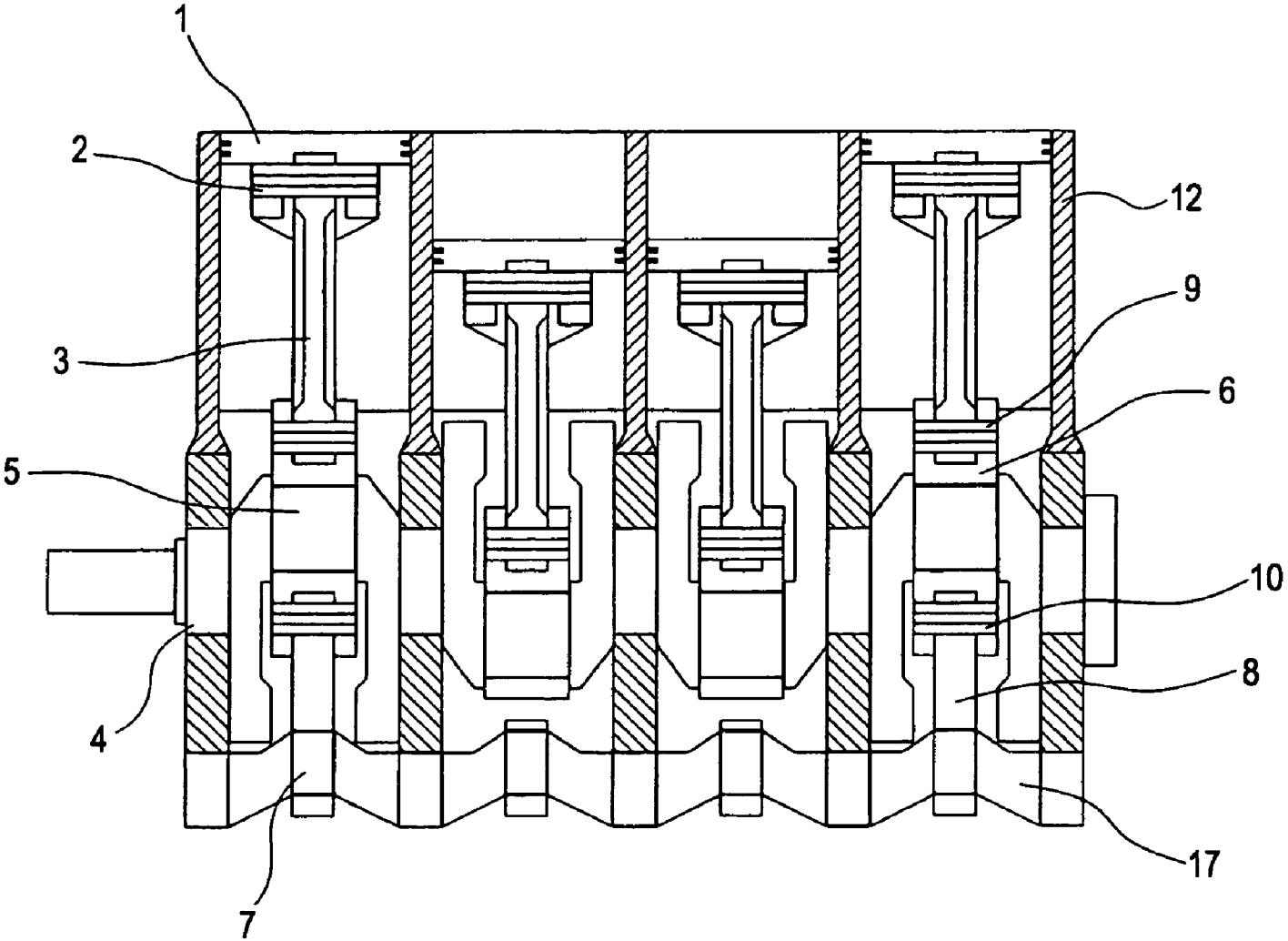
FIG. 8 is a vertical sectional view of an in-line four-cylinder combustion engine.

FIG. 7 shows a fourth exemplary embodiment. The external outlines of a crank web 4*a* and a counterweight 4*b* of a crankshaft 4 are symmetrical in a left-right direction, and a hole 23 is formed in a portion that is situated on the left of a straight line 36 in the figure. Accordingly, the center of gravity of the counterweight 4*b* is disposed rightward in the figure, that is, the center of gravity of the counterweight of the crankshaft 4 exists at the forward side in the direction of rotation of the crankshaft, so that it is possible to efficiently cancel out the inertial force of a multiple-link-type mechanism.

The preceding description has been presented only to illustrate and describe exemplary embodiments of the claimed invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope. The scope of the invention is limited solely by the following claims. The preceding description has been presented only to illustrate and describe exemplary embodiments of the claimed invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope. The scope of the invention is limited solely by the following claims.

We claim:

1. A crankshaft mechanism, comprising:

an upper link having a first end that is adapted to be connected to a piston through a piston pin;

a crankshaft having a crank pin and at least one counterweight, the at least one counterweight and the crank pin formed on opposite sides of a main journal center of the crankshaft;

a control link having a first end that is adapted to be rotatably supported on an eccentric cam provided at a control shaft supported by a cylinder block; and a lower link rotatably mounted on the crank pin, and having a first end that is adapted to be connected to a second end of the upper link through an upper pin, a second end that is adapted to be connected to a second end of the control link through a control pin, in which the crank pin is arranged to be located between the upper pin and the control pin;

wherein the upper pin is disposed on the right of the control pin when viewed in an axial direction of the crankshaft where the crankshaft rotates counterclockwise, and a center of gravity of the at least one counterweight of the crankshaft existing at a forward side in the direction of rotation of the crankshaft.

2. The crank mechanism according to claim 1, wherein a volume of the at least one counterweight at the forward side in the direction of rotation of the crankshaft is larger than a volume of the at least one counterweight at a rearward side in the direction of rotation of the crankshaft.

3. The crank mechanism according to claim 2, wherein the at least one counterweight has at least one thin-wall portion that is provided at the rearward side in the direction of rotation of the crankshaft, a thickness of the at least one thin-wall portion being smaller than a thickness of the forward side of the at least one counterweight in the direction of rotation of the crankshaft.

4. The crank mechanism according to claim 3, wherein the at least one counterweight comprises a pair of opposing counterweights, the at least one thin-wall portion comprises thin-wall portions, the thin-wall portions of the counterweights being disposed at respective opposing surfaces of the counterweights.

5. The crank mechanism according to claim 4, wherein the thin-wall portions of the counterweights are sized to overlap axial sides of a piston pin boss of the piston when the piston is at a bottom dead center, the distance between the thin-wall portions of the opposing counterweights being larger than an intended distance between axial ends of the piston pin boss.

6. The crank mechanism according to claim 2, wherein the at least one counterweight of the crankshaft is dimensioned such that a distance from a main journal center of the crankshaft to an outer periphery of the counterweight is greater at the forward side in the direction of rotation of the crankshaft than at the rearward side in the direction of rotation of the crankshaft.

7. The crank mechanism according to claim 6, wherein the at least one counterweight of the crankshaft dimensioned is such that, when a piston is at a bottom dead center, a distance between the main journal center of the crankshaft and the outer periphery of the at least one counterweight that is adapted to be closest to a piston pin boss of the piston is smaller than a distance from the main journal center of the crankshaft to a lower end of the piston pin boss of the piston.

8. A crank mechanism, comprising:

an upper link having a first end adapted to be connected to a piston through a piston pin;

a crankshaft having a crank pin and at least one counterweight, the at least one counterweight and the crank pin formed on opposite sides of a main journal center of the crankshaft;

a lower link connecting a second end of the upper link to the crank pin of the crankshaft; and a control link having a first end adapted to be rotatably supported by an eccentric cam provided at a control shaft supported by a cylinder block, the control link having a second end connected to the lower link;

an upper pin, wherein the upper link and the lower link are rotatably connected to each other through the upper pin; and a control pin, wherein the control link and the lower link are rotatably connected to each other through the control pin;

wherein the crank pin is disposed between the upper pin and the control pin, wherein a load from the lower link to the crank pin acts forwardly in a direction of rotation of the crankshaft when the piston is situated in front of a bottom dead center of the piston, and wherein a center of gravity of the at least one counterweight of the crankshaft exists at a forward side in the direction of rotation of the crankshaft.

* * * * *